United States Patent [19]

Hashimoto et al.

[11] 4,275,573

[45] Jun. 30, 1981

[54] AUTOMATIC NEEDLE SELECTION MECHANISM FOR A KNITTING MACHINE

[75] Inventors: Takeji Hashimoto, Nagaokakyo; Kiyofumi Okumoto; Masayasu Andoh, both of Kyoto, all of Japan

[73] Assignee: Dainippon Screen Seizo Kabushiki Kaisha, Kyoto, Japan

[21] Appl. No.: 104,269

[22] Filed: Dec. 17, 1979

[30] Foreign Application Priority Data

Mar. 14, 1979 [JP] Japan ..... 54-23638

[51] Int. Cl.[3] ..... D04B 7/00; D04B 15/66

[52] U.S. Cl. ..... 66/75.2

[58] Field of Search ..... 66/75.2, 218, 221, 219, 66/231, 60, 60 H

[56] References Cited

U.S. PATENT DOCUMENTS 4,030,319 6/1977 Gloeckler ..... 66/75.2

FOREIGN PATENT DOCUMENTS 2003254 11/1969 France ..... 66/75.2

1200468 7/1970 United Kingdom ..... 66/75.2

*Primary Examiner*—Ronald Feldbaum

*Attorney, Agent, or Firm*—Michael A. Painter

[57] ABSTRACT

An automatic needle selection mechanism for a knitting machine, comprising one electromagnet for each of needle selectors, and a movable mounting plate for the electromagnets, arranged facing a selector bed. Each mounting plate with the electromagnetic is brought adjacent to its corresponding selector when the selector is in its first position where it is engaged to the movement of the selector bed. The mounting plate is first approached to the selector bed, and then the electromagnet is selectively energized. Then, the mounting plate is moved away from the selector bed. The selector which corresponds to the electromagnet energized is moved from the first position to the second position where it is disengaged from the selector bed, subsequent movement of the selector bed in the longitudinal direction of the selector thereby actuating the selected one of the needles in order to form a desired knitting pattern.

3 Claims, 6 Drawing Figures

AUTOMATIC NEEDLE SELECTION MECHANISM FOR A KNITTING MACHINE

This invention relates to knitting machines, and particularly to knitting machines in which a number of knitting needles are actuated by a number of selectors.

In conventional manual knitting machines, and weft knitting machines, the setting up of the needle arrangement for each particular knitting pattern has heretofore been mechanically performed by means of punched cards. The manual preparation of these punched cards from drawings of the patterns has required great time and cost.

Recently, machines for preparing punched cards from video signals obtained by photoelectrically scanning a drawing of a pattern have become practically available, and improvements to accuracy and speed of work have been thereby attained. However, when the knitting pattern is to be changed, the whole card deck still has to be replaced, and, further, it is difficult partially to modify a pattern.

Recently, therefore, we have conceived the idea of eliminating the abovementioned disadvantages by using the video signals, directly or via a magnetic tape, to activate electromagnets for selecting certain selectors to provide a desired arrangement of knitting needles. However, there are certain difficulties to be overcome in order to make a practical machine.

First, as the width of the smallest practical electromagnet is far greater than the distance between selectors in a knitting machine—which is typically 1.5 to 2.0 mm—simply arranging the electromagnets in a row will not do, because there is not enough space for them.

Second, if the electromagnets are fixed, it is very difficult to attract only the desired selectors by activating selected electromagnets, and there is a likelihood of the neighboring selectors being attracted by magnetic leakage, resulting in mis-operation.

Third, if it is conceived that the selectors which correspond to the needles which are to be used are to be attracted by the electromagnets, then a large number of electromagnets must be energized. Accordingly, power consumption will be formidable, especially if the electromagnets must be energized during the entire process of knitting the row.

It is one object of the present invention to provide an automatic needle selection mechanism which is free from one or more of the above-mentioned disadvantages.

According to one aspect of the present invention there is provided, for a knitting machine in which a plurality of knitting needles are actuated by a plurality of knitting needle selectors which are arranged side by side in parallel as slidably engaged in a selector bed which is movable to an fro in the longitudinal direction of said needle selectors to actuate said needles, each of said selectors being movable in its lateral direction between a first position in which it is engaged to said movement of said selector bed, and a second position in which it is disengaged from said movement of said selector bed: an automatic needle selection mechanism, comprising one electromagnet for each of said selectors, and a movable mounting plate, on which said electromagnets are mounted, arranged facing said selector bed and movable towards and away from said selector bed so that each of said electromagnets may be brought adjacent to its corresponding selector when said selector is in its first position; whereby, when all said selectors are in their first positions where they are engaged to said movement of said selector bed, and said mounting plate is first approached to said selector bed, and then said electromagnets are selectively energized, and then said mounting plate is moved away from said selector bed, only those of said selectors which correspond to those of said electromagnets which are energized are moved from their said first positions to their said second positions where they are disengaged from said selector bed, subsequent movement of said selector bed in said longitudinal direction of said needle selectors thereby actuating only selected ones of said needles, in order to form a desired knitting pattern.

According to another particular aspect of the present invention there is provided an automatic knitting needle selection mechanism of the above sort, wherein said electromagnets are mounted on said mounting plate in a stepped arrangement relative to one another.

According to another particular aspect of the present invention there is provided an automatic knitting needle selection mechanism of either of the above sorts, further comprising a pushing mechanism which transmits pressure exerted by said mounting plate as said mounting plate approaches said selector bed so as to push each selector a small amount towards its corresponding electromagnet.

An automatic needle selection mechanism according to the present invention will now be described, by way of example, with reference to the accompanying drawings, in which.

Figure 1:
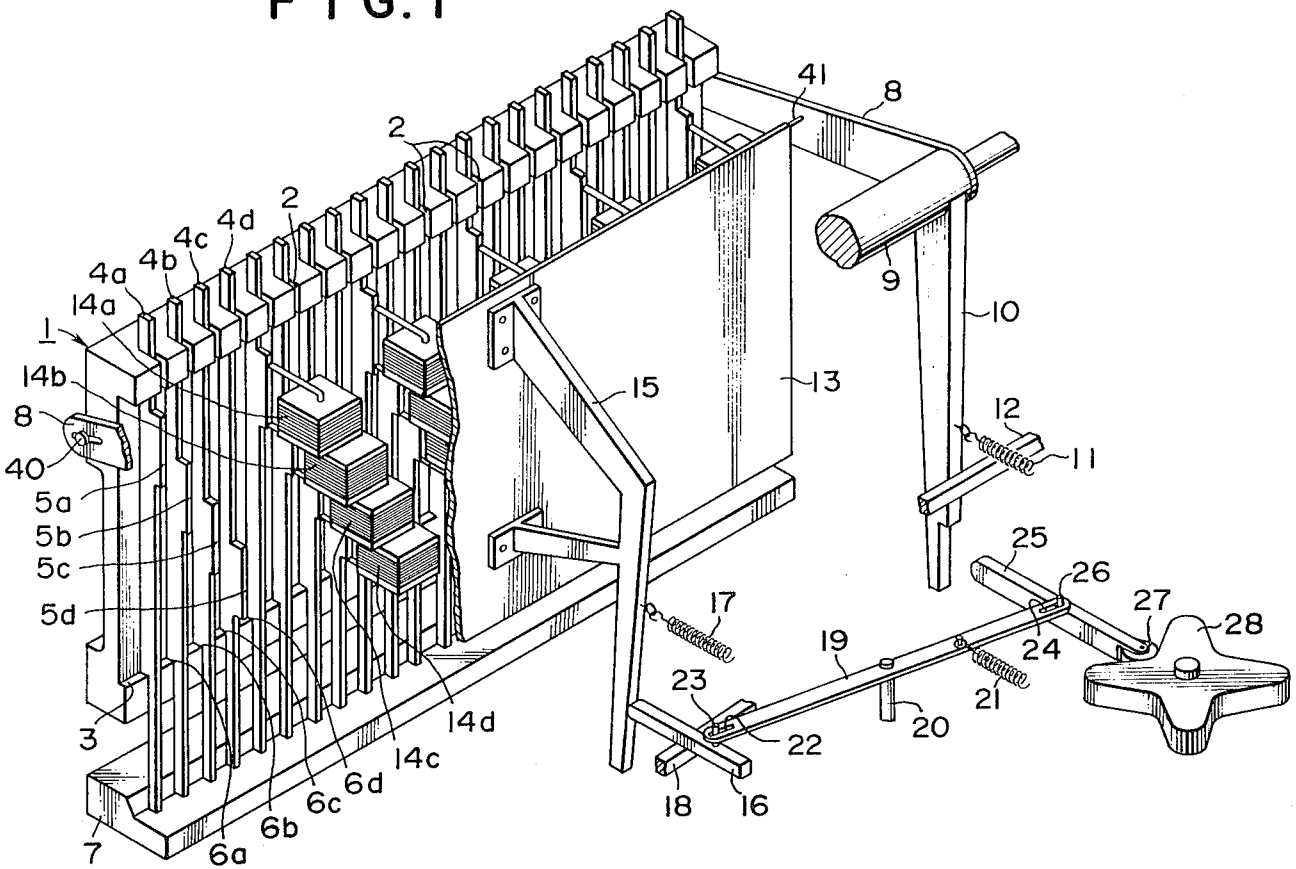
FIG. 1 is a partly broken away perspective view of the knitting machine, showing the needle selection mechanism.

Referring to the drawings, and particularly to FIGS. 1–4, in FIG. 1 there is shown in perspective form a partial view of a knitting machine. A number of slots 2 extending vertically and arranged side by side are milled in an upper projecting rib on the front surface of a vertically disposed selector bed 1, and on the lower front surface of this selector bed is further formed a laterally extending rib or step 3.

The reference numerals 4*a*, 4*b*, 4*c*, 4*d*, . . . denote selectors, each of which is in the form of an elongated bar extending vertically. On the front part of each selector, a projection 5*a*, 5*b*, 5*c*, or 5*d* is formed, facing forwards. These projections are at different heights on adjacent selectors, and, in the illustrated example of the present invention, the staggered pattern of the heights of the projections repeats every four selectors, as may be seen from the drawing.

The upper portion of each selector 4 is slidably inserted in one of the slots 2 formed in the selector bed 1. On the lower part of the back surface of each selector 4 a step 6 is formed. This step 6 is engaged with the selector bed 1 by freely resting on the step 3. Further, the bottom end of each selector is supported by a horizontal support 7, which does not move, and which runs below the lower edge of the selector bed 1.

To both sides of the selector bed 1 are attached the ends of arms 8 for vertically moving the selector bed 1, by pins on the bed and slots in the arms. The front end of each arm 8 is fixed to a laterally extending axle 9. On an appropriate place on the axle 9 is fixed a downwardly extending lever 10 which is biased in the forward direction by a spring 11. 12 denotes a stop for the lever 10.

A movable mounting plate 13 is arranged in front of the selector bed 1, generally parallel to it, and pivots 41 projecting from both the sides of the upper edge of the mounting plate are pivotally supported by the arms. On the rear surface of the movable mounting plate 13 are mounted a number of electromagnets 14, each facing a corresponding projection 5 of a selector 4, there being one electromagnet for each selector. The electromagnets are thus arranged at different heights, as 14*a*, 14*b*, 14*c*, and 14*d*, corresponding to the various heights of the projections 5*a*, 5*b*, 5*c*, and 5*d*. Thereby, although the electromagnets are thicker than the spacing between the selectors, it is possible to fit all the electromagnets into the space available on the movable mounting plate 13.

On the center of the front surface of the mounting plate 13, a lever 15 which extends forwards and then downwards is fixed, and a push rod 16 projects forward from the lower part of the front surface of the lever 15. The lever 15 is biased forwards by a tension spring 17.

19 denotes a connecting rod pivotally supported in the middle by a pivot 20, and it is biased in the clockwise direction as viewed from above in FIG. 1 by a tension spring 21, which has a greater restoring force than the spring 17.

A slot 22 formed in the left end of the connecting rod 19 is engaged with a pin 23 projecting from the front upper surface of the push rod 16, and a similar slot 24 formed in the right hand end of the connecting rod 19 is engaged with a pin 26 projecting from the middle upper surface of a push rod 25 extending forward and backward in front of the lower end of the lever 10 for elevating the selector bed 1. A horizontal roller 27, pivotally attached to the front end of the push rod 25, is in contact with a cam 28 rotating horizontally in front of the roller 27.

Figure 2:
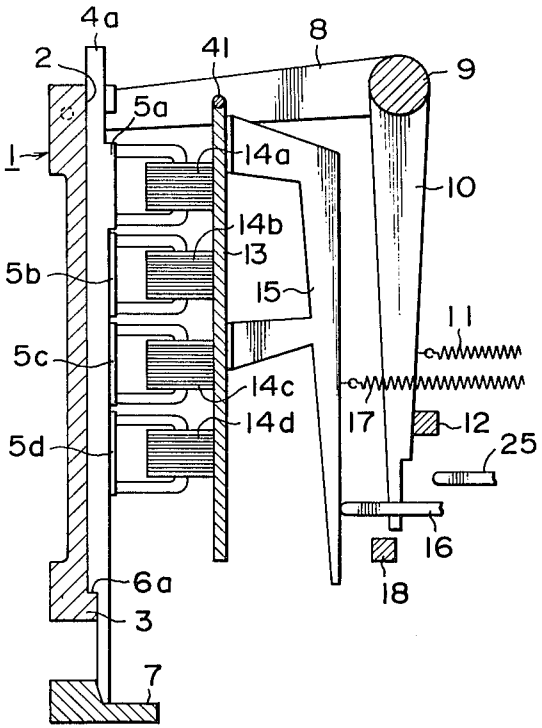
FIG. 2 is a cross-sectional view of the machine shown in FIG. 1, taken parallel to the longitudinal direction of the needle selectors, and perpendicular to the mounting plate, showing the selectors in their reset state.

In the mechanism explained above, when the roller 27 is located in the deepest recess of the cam 28, as shown in FIG. 1, the push rod 25 and the lever 10 are removed from one another, and the selector bed 1 assumes its lower position, as shown in FIG. 2.

Further, the movable mounting plate 13 is moved backwards, against the restoring force of the spring 17, as the push rod 16 is pushed by the connecting rod 19, and every one of the electromagnets 14 is in a position adjacent to its corresponding projection 15 of its corresponding selector 4.

Then those electromagnets adjacent to the selectors for unnecessary knitting needles, which are not required for the knitting process, are selectively energized in accordance with video signals obtained by photoelectrically scanning a pattern drawing, and attract their selectors. In the drawings, the electromagnets 14*c* are shown as energized and attracting the selectors 4*c*, but of course any combination may be selected, according to the desired knitting pattern.

Figure 3:
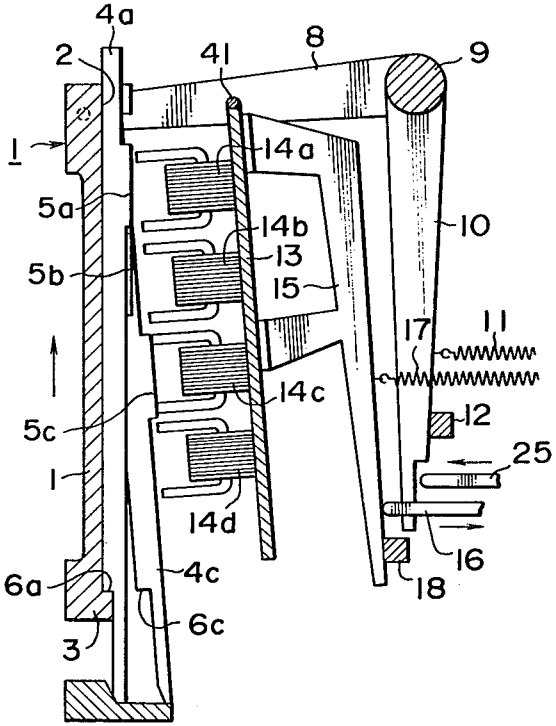
FIG. 3 is a view similar to FIG. 2, showing the selectors in their extracted state.

As the cam 28 rotates, the push rod 25, as shown in FIG. 3, moves, pressed by the cam 28, until it begins pushing the lower end of the lever 10, and simultaneously the mounting plate 13, engaged with the push rod 25 via the connecting rod 19, tilts forwards, away from the selectors, about the pivot pin 41.

As a result, those selectors which are attracted to the electromagnets which are energized (electromagnets 14*c* in the drawings) are extracted from the selector bed 1, and their steps 6 on their lower parts are disengaged from the step 3 along the bottom edge of the selector bed 1. Then the electromagnets are de-activated.

Figure 4:
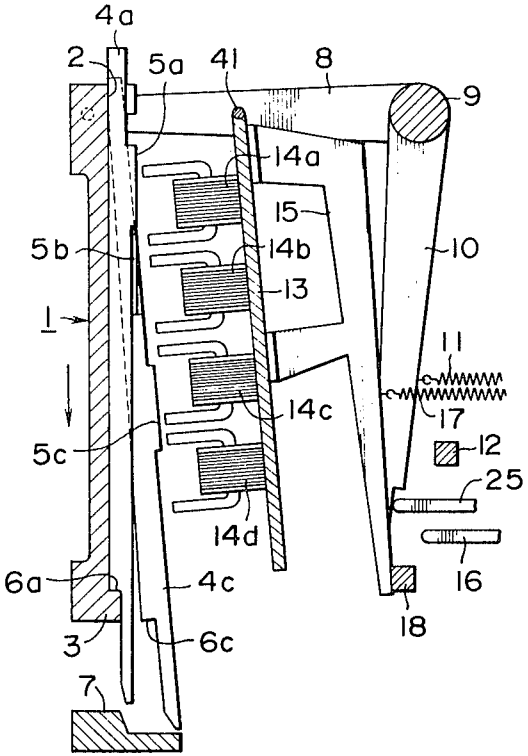
FIG. 4 is a similar view, showing the operation of selection of the needles.

As the cam 28 further rotates, and the roller 27 goes over a crest of the cam 28, the push rod 25 further pushes the lever 10 so that the selector bed 1 is elevated along with the rest of the selectors which have not been attracted by their electromagnets, for disposing the knitting needles (which are not shown in the drawings, but are located above the selectors) in a ready-for-knitting position. This is shown in FIG. 4.

As the cam 28 further rotates, until the roller 27 again comes down to the recess of the cam 28, the movable mounting plate 13 moves backwards simultaneously as the selector bed 1 is lowered, and the displaced selectors are returned to their original positions in the selector bed 1, pushed by their electromagnets 14, eventually resuming their original positions, as shown in FIG. 2.

Figure 5:
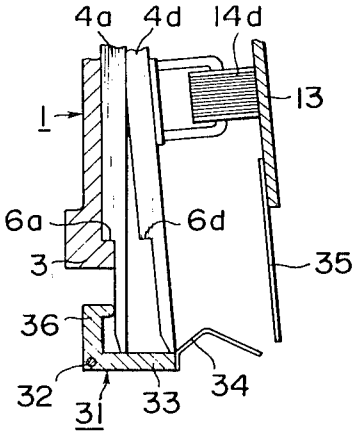
FIGS. 5 and 6 are views showing a modification of the machine of FIGS. 1–4, when the needles are in the extracted state, and in the reset state, respectively.
Figure 6:
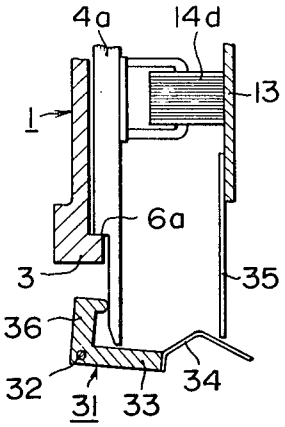

As a modification of the above described structure, if, instead of the support 7, a pivoted plate 31 as shown in FIG. 5 is provided, which has a L-shaped section, said plate 31 being pivoted to the machine frame (which is not shown) by a horizontal pin 32, with the lower ends of the selectors 4 being freely supported by the horizontally extending piece 33 of the plate 31, and with an inverted V-shaped sheet spring 34 being attached to the front edge of the horizontal piece 33 and a pressure piece 35 being appended from the lower edge of the mounting plate 13 in a manner to push the sheet spring 34 downward as the mounting plate 32 travels backwards, so as to incline the pivoted plate 31 clockwise in the diagram, and thus to move the vertical piece 36 of the pivoted plate 31 forwards so as to push all the selectors slightly forwards towards the electromagnets, then the contact between the selectors and the electromagnets will become much more certain.

Thus, according to the present invention, the electromagnets are, as described above, laterally disposed as staggered relative to one another, so that as many electromagnets as selectors may be mounted on a single mounting plate, even though the electromagnets are much thicker than the distance between the selectors.

Further, by the device of moving the mounting plate of the electromagnets towards and away from the selector bed, the electromagnets only need attract selectors when they are very close to them, and so small electromagnets may be used, which improves needle selection, as there is no risk of leakage of magnetic flux attracting neighboring selectors.

Further, by the movement of the mounting plate, only electromagnets which correspond to unused selectors need be energized, rather than those which correspond to selectors which are to actuate needles which are to be employed for knitting. Thus the number of electromagnets which have to be energized is considerably reduced. Further, they do not have to be energized during the entire process of knitting the row, but only while displacing the selectors which are not to be used, so that they are not in engagement with the selector bed 1.

In other embodiments of the present invention, of course the mechanism composed of the cam 28, etc., for moving the mounting plate and the selector bed could be different. Further, the exact details of the arrangement of the projections of the selectors and of the electromagnets are not important, as long as the electromagnets are staggered with respect to one another, so that they can be fitted on the mounting plate in the space available, which cannot be done if they are all mounted in a row.

What we claim is:

1. For a knitting machine in which a plurality of knitting needles are actuated by a plurality of knitting needle selectors which are arranged side by side in parallel as slidably engaged in a selector bed which is movable to and fro in the longitudinal direction of said needle selectors to actuate said needles, each of said selectors being movable in its lateral direction between a first position in which it is engaged to said movement of said selector bed, and a second position in which it is disengaged from said movement of said selector bed:

an automatic needle selection mechanism, comprising one electromagnet for each of said selectors, and a movable mounting plate, on which said electromagnets are mounted, arranged facing said selector bed and movable towards and away from said selector bed so that each of said electromagnets may be brought adjacent to its corresponding selector when said selector is in its first position; whereby, when all said selectors are in their first positions where they are engaged to said movement of said selector bed, and said mounting plate is first approached to said selector bed, and then said electromagnets are selectively energized, and then said mounting plate is moved away from said selector bed, only those of said selectors which correspond to those of said electromagnets which are energized are moved from their said first positions to their said second positions where they are disengaged from said selector bed, subsequent movement of said selector bed in said longitudinal direction of said needle selectors thereby actuating only selected ones of said needles, in order to form a desired knitting pattern.

2. An automatic needle selection mechanism as in claim 1, wherein said electromagnets are mounted on said mounting plate in a stepped arrangement relative to one another.

3. An automatic needle selection mechanism as in claim 1 or claim 2, further comprising a pushing mechanism which transmits pressure exerted by said mounting plate as said mounting plate approaches said selector bed so as to push each selector a small amount towards its corresponding electromagnet.

* * * * *